United States Patent [19]

Smith

[11] 4,094,416

[45] June 13, 1978

[54] SUPPORT FOR DISPENSING PACKAGES

[76] Inventor: James A. Smith, 19 Donelon Dr., Harahan, La. 70123

[21] Appl. No.: 792,105

[22] Filed: Apr. 29, 1977

[51] Int. Cl.[2] ..... A47F 7/17

[52] U.S. Cl. ..... 211/71; 211/88; 225/42; 248/311.1 R

[58] Field of Search ..... 211/71, 88; 248/DIG. 5, 248/311.1, 270, 271; 225/42, 44

[56] References Cited

U.S. PATENT DOCUMENTS

| | | | |
|---|---|---|---|
| 2,543,169 | 2/1951 | Hicks | 248/311.1 |
| 2,984,395 | 5/1961 | Catlett et al. | 225/42 |
| 3,071,728 | 1/1963 | Grace et al. | 248/311.1 X |
| 3,229,844 | 1/1966 | Simon | 248/311.1 X |
| 3,870,212 | 3/1975 | Polk | 225/42 |

FOREIGN PATENT DOCUMENTS

| | | | |
|---|---|---|---|
| 268,391 | 7/1966 | Australia | 248/271 |
| 611,351 | 10/1948 | United Kingdom | 221/88 |

*Primary Examiner*—Roy D. Frazier
*Assistant Examiner*—Robert W. Gibson, Jr.
*Attorney, Agent, or Firm*—B. P. Fishburne, Jr.

[57] ABSTRACT

A panel body portion can be attached to a wall or to the inside of a kitchen cabinet door. The panel body portion can include a rear compartment for loose paper bags and the like defined by marginal flanges which cause the panel body portion to stand off from the supporting door or wall. Two way adjustable holders for dispensing packages of various sizes and types are mounted on the panel body portion at a plurality of elevations. Packages for foil, plastic wrap, wax paper and various types of bags are accommodated by the invention. Each holder embodies end holder units whose spacing may be varied longitudinally of the package and whose width may also be varied to accommodate packages of varying widths.

11 Claims, 9 Drawing Figures

FIG.1
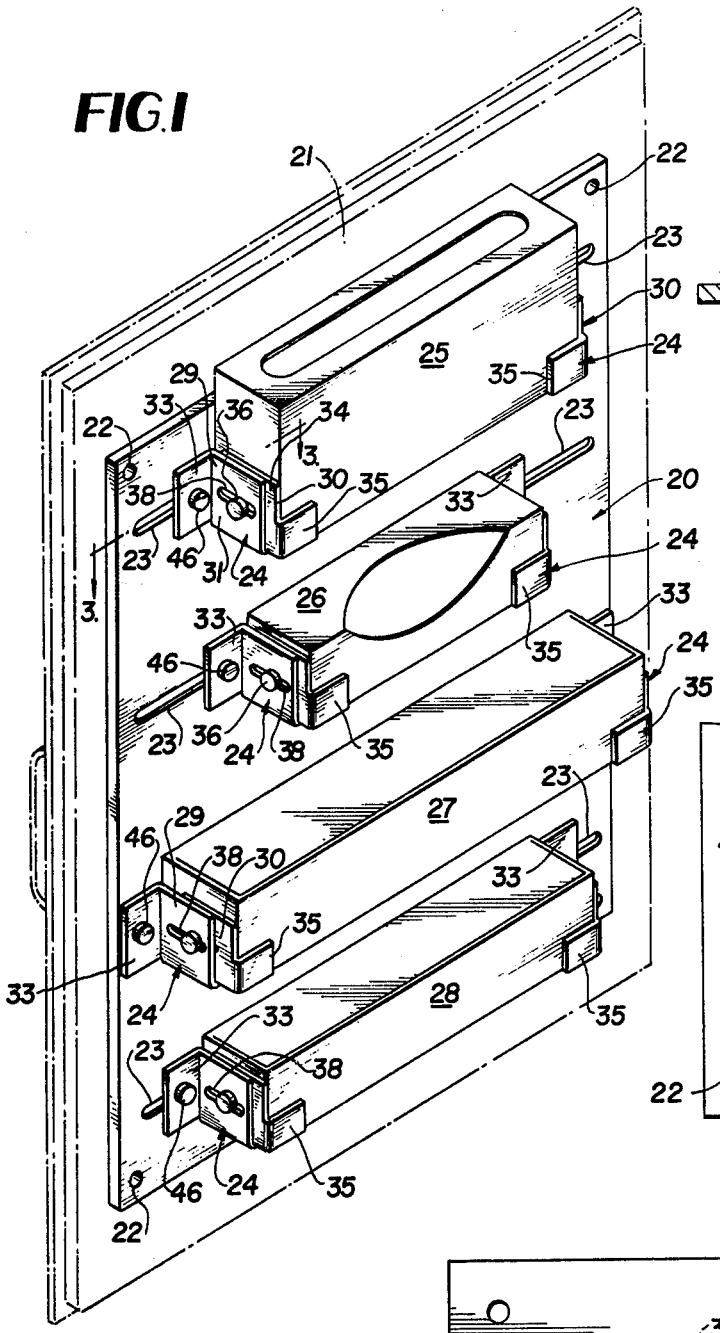
FIG.3
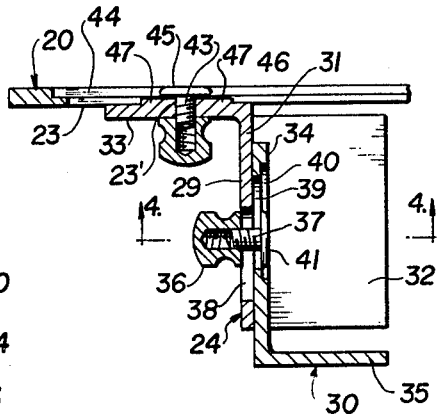
FIG.4
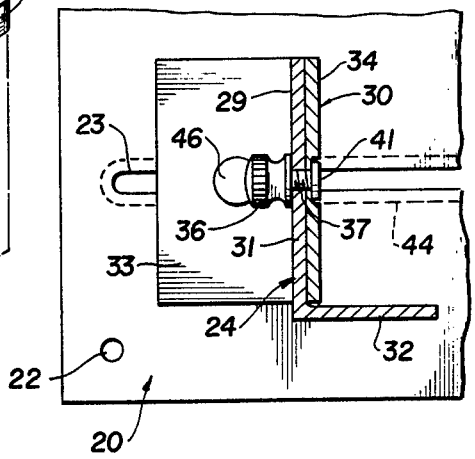
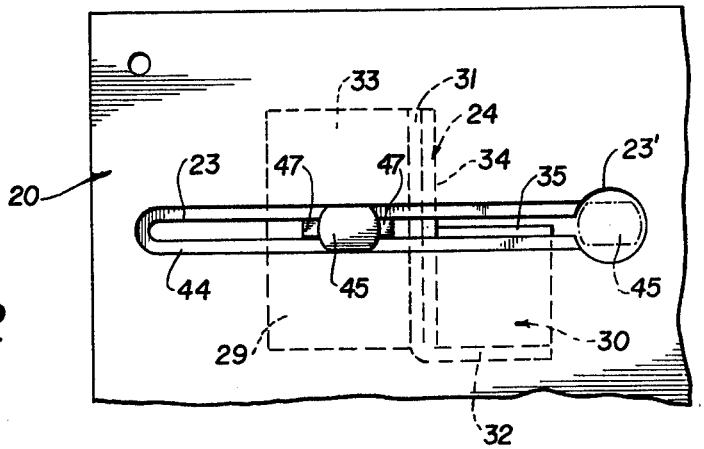
FIG.2

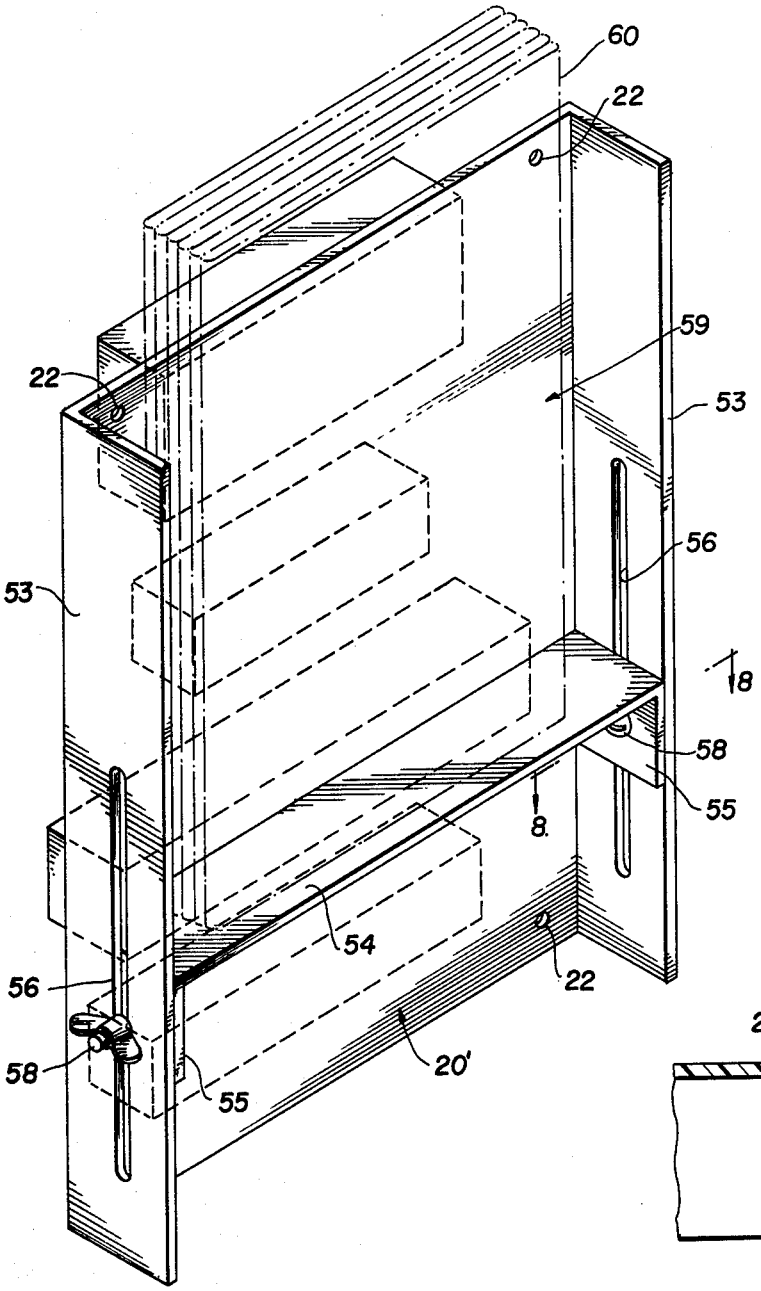
FIG. 7
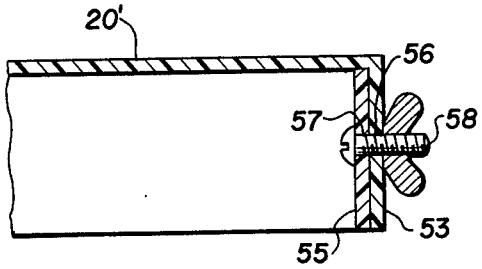
FIG. 8
FIG. 9
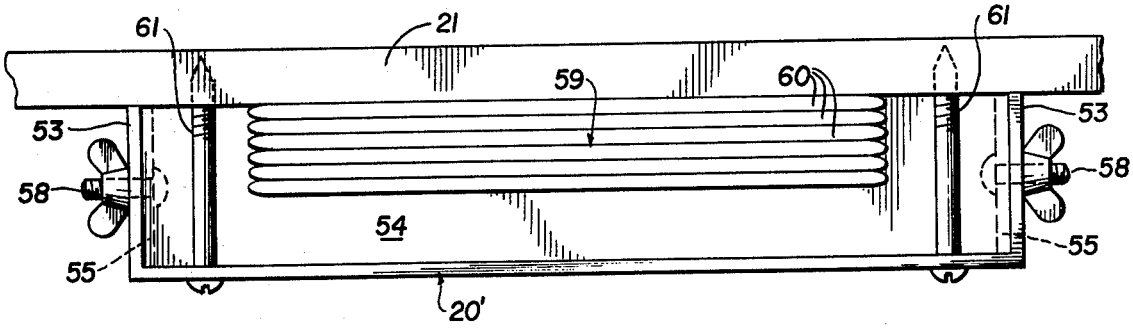

SUPPORT FOR DISPENSING PACKAGES

BACKGROUND OF THE INVENTION

The normal household utilizes packaged foil, plastic wrap, wax paper, packaged food and sandwich bags and packaged trash bags. The typical housewife places all of the packages in a drawer or on a kitchen cabinet shelf in a scrambled fashion. When an occasion arises necessitating the use of a particular dispensing package, the user must fumble through the drawer and locate the package, pick it up and remove it from the drawer and after withdrawing a section of wrap or a bag, return the package to its usual hiding place.

In view of this haphazard and somewhat chaotic practice, a distinct need exists for a convenient and economical holding or supporting means for various types and sizes of dispensing packages, whereby the housewife or other user can quickly locate a certain package without fumbling or searching and easily remove a bag or a section of wrap in a most efficient manner, without picking up the package or displacing it in its support.

The object of the invention is, therefore, to completely satisfy the above need in terms of an economical, durable and very convenient supporting means for dispensing packages of the above-noted type, the supporting means constituting a unit which can be attached to the interior of a kitchen cabinet door or to any vertical support surface, such as the wall of a pantry. The device can also be installed at an angle or horizontally by using a simple attachment part to prevent displacement of the package in a horizontal plane. The invention can also provide convenient storage space for loose paper bags between the panel body portion of the invention and the cabinet door or wall on which it is mounted. This is an optional feature which can be omitted, if preferred. The invention is characterized by simplicity and convenience of use.

Some examples of the known patented prior art are contained in the following U.S. Pat. Nos:

| | |
|---|---|
| 381,041 | 2,543,169 |
| 436,097 | 2,614,015 |
| 1,082,939 | 2,984,395 |
| 1,866,308 | 3,870,212. |

SUMMARY OF THE INVENTION

A convenience holder or support for variously sized rectangular dispensing packages comprises a flat panel body portion attachable to a vertical support surface and having horizontal holder unit adjusting slots at plural elevations. Paired holder units for packages of different lengths are movable lengthwise of the panel slots and lockable in selected adjusted positions. Each holder unit consists of a pair of angle brackets forming a holding socket for one end of a dispensing package. One angle bracket of each holder unit is adjustable on the other angle bracket toward and away from the panel body portion and lockable in a selected position, so that packages of varying widths can be accommodated by the invention. An attachment angle bracket is provided for use on the holder units when the invention is installed in a horizontal or nearly horizontal position. In a modification of the invention, a compartment for loose paper bags or the like is provided on the rear of the panel body portion by attached side flanges and a vertically adjustable bottom support ledge. In this instance, the panel body portion stands off from the supporting surface for the invention.

BRIEF DESCRIPTION OF THE DRAWINGS

FIG. 1 is a perspective view of the invention showing the same attached to the interior of a cabinet door.

FIG. 2 is a fragmentary rear elevation of the invention.

FIG. 3 is an enlarged fragmentary vertical section taken on line 3—3 of FIG. 1.

FIG. 4 is a vertical section taken on line 4—4 of FIG. 3.

FIG. 7 is a rear perspective view of the invention according to a modification.

FIG. 8 is an enlarged fragmentary horizontal section taken on line 8—8 of FIG. 7.

FIG. 9 is a plan view of the invention as shown in FIG. 7.

DETAILED DESCRIPTION

Figure 5:
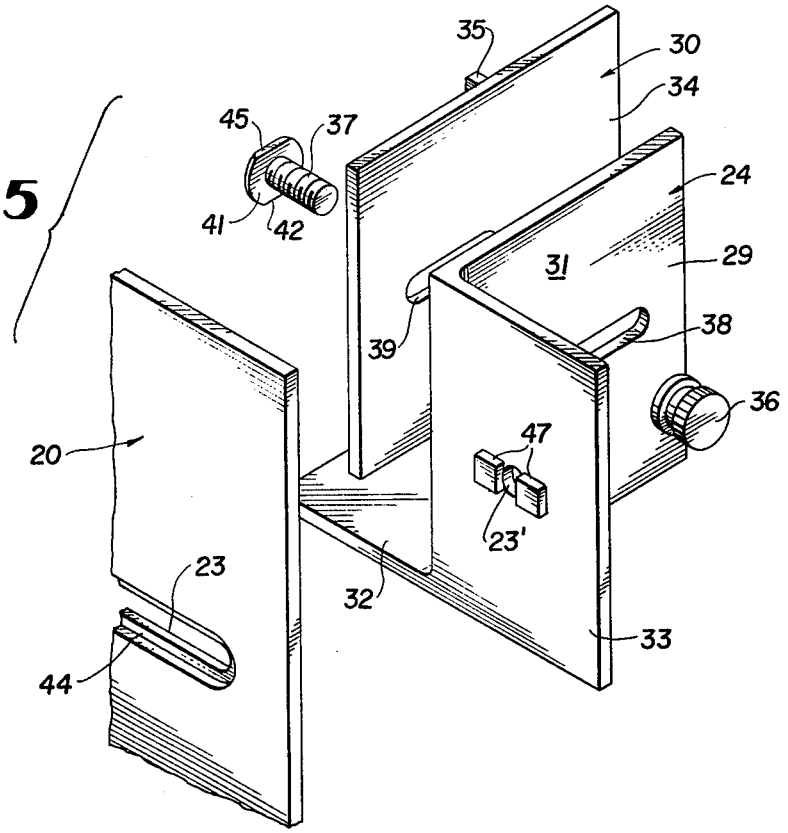
FIG. 5 is an exploded perspective view of the invention showing one holder unit in relation to the panel body portion.

In the accompanying drawings forming a part of this application and in which like numerals designate like parts throughout, and initially considering FIGS. 1 to 5, the numeral 20 designates a flat rectangular panel body of appropriate size adapted to be secured to the interior of a kitchen cabinet door 21 or mountable in a similar manner on the wall of a pantry or kitchen or any other available support surface. Preferably, the invention is mounted vertically as shown in FIG. 1 but in some cases it can be disposed horizontally as will be discussed in connection with FIG. 6. The panel body 20 can be attached to the vertical door 21 by conventional adhesive means, or if preferred, by means of screws inserted through corner apertures 22 in the panel body.

The flat panel body 20 is provided at a plurality of different elevations with spaced aligned pairs of horizontal adjustment slots 23 for paired dispenser package end holder units 24. The end holder units 24 of each horizontally opposed pair are identical in construction and operation and therefore a detailed description of one unit of the invention will suffice to describe all units.

As illustrated in FIG. 1, the invention can accommodate various shapes and sizes of rectangular dispensing packages in vertically spaced parallel arrangement. The topmost unit of the invention composed of a pair of the end holding units 21 is adapted to support a comparatively tall top opening dispensing package 25 for trash bags or the like. The next lowermost invention unit can hold a comparatively small dispensing package 26 for plastic sandwich bags or the like. The next lowermost unit can hold a large size package 27 for aluminum foil or wax paper having the usual built-in cutting edge which facilitates withdrawing and severing a length of foil or paper of any particular size. The lowermost unit of the invention can support a somewhat smaller, regular size package 28 of foil, wax paper or plastic film wrap. The invention is not limited to any particular number of package holding units or precise arrangement of packages, and the arrangement shown in FIG. 1 is illustrative only and may be varied under the invention. It is logical, however, to place the taller top opening package 25 at the top of the panel body 20 to facilitate its use with maximum convenience.

Continuing to refer to the drawings, each package end holder unit 24 comprises two angle bracket components 29 and 30. The bracket 29 includes a vertical web 31 and an attached horizontal package support web 32 which lies beneath one end portion of the rectangular package. Each bracket 29 further includes an attached vertical mounting flange 33 by means of which the bracket 29 is adjustably engaged with one of the horizontal slots 23. The webs 31 and 32 and the flange 33 are integrally joined in right angular relationship as illustrated.

The bracket 30 includes a vertical web 34 lying immediately inwardly of the vertical web 31 and an attached right angular vertical web 35 which laps one lower forward corner of the package being held by the invention. Preferably, the web 35 extends for only one-half the height of the angle bracket 30, as illustrated.

Each bracket 30 is attached adjustably to the associated bracket 29 by a threaded fastener which includes a knurled nut 36 and a shallow head screw 37. The screw 37 is received through registering horizontal adjustment slots 38 and 39 in the flanges or webs 31 and 34, FIG. 3. The slot 39 is countersunk as at 40 to receive the flat head 41 of screw 37. The screw head 41 has parallel straight edges 42, FIG. 5, which lie in the countersunk portion 40 of slot 39 and resist turning. The arrangement is such that each bracket 30 can be moved relative to the associated bracket 29 toward and away from the panel body 20, whereby each end holder unit 24 is adjustable to conform to the width of the package placed therein. For example, in FIG. 1, the package 25 is comparatively wide in the direction away from the vertical panel body 20 and the above-described adjustable connection allows the brackets 30 at the opposite ends of the package to be moved lengthwise of the slots 38 and 39 to the necessary positions and locked by tightening the nuts 36. It will be understood that the bottom of the dispensing package rests on and is supported by the horizontal webs 32, and the forward and rear side walls of the package are retained between the vertical webs 35 and the front face of panel body 20.

In a similar manner, the companion holder units 24 for each dispensing package are adjustable lengthwise of the package so that packages of different lengths can be accommodated through a rather wide range of package sizes. For this purpose, additional threaded fasteners 43 are placed forwardly through apertures 23' of flanges 33 and through the horizontal slots 23, which are undercut at 44 on the rear side of the panel body 20, to receive the shallow heads 45 of fasteners 43 in the same manner previously described relative to the fasteners 37. The arrangement is such that all of the fastener heads are flush mounted and resist rotation. At their forward ends, the fasteners 43 receive knurled nuts 46 which are firmly tightened to lock the two companion holder units 24 in their selected adjusted positions along the slots 23 so that the holder units can snugly embrace the opposite ends of the package.

To further resist turning of each bracket 29 on the axis of screw fastener 43, a pair of lugs 47, FIG. 2, are formed on each flange 33 and are received in the straight slot 23 slidably and guidedly. This arrangement effectively maintains the brackets 29 in proper squared relationship on the panel body 20 and the lugs do not interfere with the adjustment of the units 24 lengthwise of the slots 23.

It is now clear that each unit or assembly of the invention for holding any of the packages shown in FIG. 1 consists of two of the units 24 and each such unit is adjustable lengthwise of the slots 23 and is expandable away from the plane of panel body 20 to accept packages of increased thickness. FIG. 1 illustrates a range of adjustability of the holder units 24 in connection with several different sizes of dispensing packages 25, 26, 27 and 28. It is apparent from this illustration that the invention can accommodate practically all types of household rectangular dispensing packages or boxes for the goods already mentioned.

Figure 6:
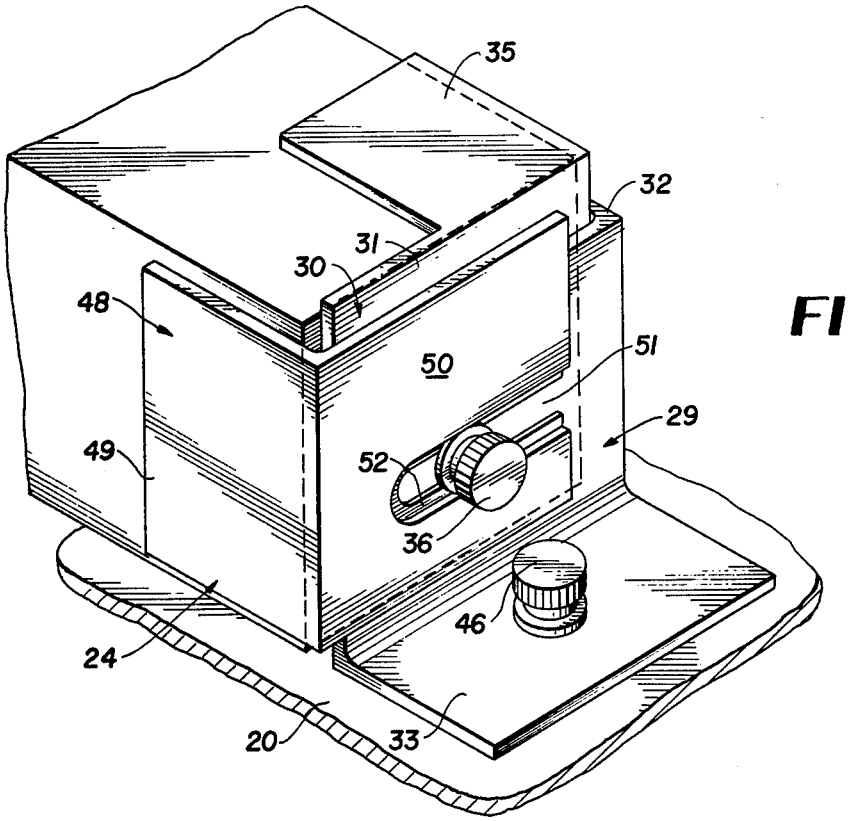
FIG. 6 is a fragmentary perspective view of the invention showing an attachment part employed when the invention is installed horizontally.

FIG. 6 shows a variant of the invention as disclosed in FIGS. 1 to 5 to take care of situations where it is necessary due to lack of a suitable vertical support surface to mount the panel body 20 horizontally rather than vertically. In FIG. 6, an attachment L-shaped retainer bracket 48 having right angular flanges 49 and 50 is employed with the flange 49 arranged vertically and overlapping one end portion of the dispensing package which would normally be the top face of the package were the invention vertically arranged as in FIG. 1. When horizontally arranged, however, the overlapping flange 49 restrains the package in a third direction so that it cannot be displaced horizontally and separated from its two holding units. The basic holding units 24 in FIG. 6 are unchanged from those already described in FIGS. 1 to 5 and only the attachment brackets or retainers 48 have been added. The web 50 of each such bracket is horizontally slotted at 51, FIG. 6, and the previously-described nut 36 enters the undercut outer side 52 of the slot 51 when the parts are adjusted and locked into position. The attachment bracket 48 can be shifted to any required position horizontally or lengthwise of the slot 51. The nut 36 is threadedly engaged with the screw 37 previously described in FIG. 5. It will be understood that the bracket 48 is required only when the invention is installed in a horizontal or near horizontal position.

FIGS. 7 to 9 show a second embodiment of the invention which is essentially unchanged from the embodiment in FIGS. 1 to 5 insofar as the basic adjustable package holding units 24 are concerned in their relation to the packages being held and to the panel body 20 on which they are mounted. However, in FIGS. 7 to 9, the rectangular panel body 20 is equipped on its rearward side, or facing the interior of the door 21, FIG. 1, with a pair of side vertical parallel flanges 53 of the same width. These side flanges are integrally formed with the panel body 20' and project rearwardly therefrom at right angles thereto. It may be noted here that all elements of the invention except the threaded fasteners are well adapted to be molded from any tough fracture-resistant plastic material, although other suitable materials could be employed and the invention is not limited to plastics materials.

A vertically adjustable horizontal ledge member 54 is arranged at the rear face of panel body 20' and preferably has the same width as the two flanges 53. The ledge member 54 has opposite end right angular depending legs 55 which lie inwardly of the flanges 53. The flanges 53 are vertically slotted at 56 and the legs 55 have apertures 57 in registration with the slots 56. Threaded fasteners 58 serve to connect the ledge member 54 adjustably to the flanges 53 so that the ledge member can be adjusted vertically to any position along the two slots 56.

The described arrangement forms an open top adjustable depth compartment 59 for loose paper bags 60 and the like between the rear of the vertical panel 20' and the interior face of the cabinet door 21 on which the invention is mounted. This adds significantly to the utility of the dispensing package holder without altering in any way the basic parts mounted on the forward face of the panel body, as previously described and clearly shown in FIG. 1.

The modification of FIGS. 7 to 9 has the added advantage of making the panel body 20' stand off from the opposing face of the door 21 or wall surface. This allows long screws 61, FIG. 9, to be utilized in the corner openings 22 of the panel body and when these screws are tightened, the flanges 53 which extend for the full height of the panel body, have their longitudinal edges drawn tightly against the opposing face of door 21. This dispenses with the necessity for the undercut portions 44 in the slots 23 of the panel body and eliminates the flush screw heads 45 shown in FIG. 3. In all other respects the invention remains unchanged from the embodiment in FIGS. 1 to 5. In both embodiments, the invention is very simple, comparatively economical to manufacture, has a wide range of adjustability and is most convenient to use. It literally brings order out of chaos in the management and handling of the various types of dispensing packages. The housewife can tell at a glance when the packages are nearly empty and need renewing and this is another great advantage over keeping the packages in jumbled condition in a drawer. The advantages of the invention over the prior art should now be apparent to those skilled in the art.

The invention has one other feature which should be noted, and this feature is illustrated in FIG. 2 of the drawings. As shown in FIG. 2, each horizontal slot 23 in panel body 20 has an enlarged circularly curved inner end terminal 23' of sufficient diameter to allow the fastener heads 45 to pass therethrough. This feature makes it convenient to separate the end holder units 24 from the panel body 20 by merely shifting the units to the inner ends of slots 23 and removing the heads 45' through the enlarged slot terminals 23'. It is unnecessary to remove the knurled nuts 46 from the threaded fasteners 43 or to remove the panel body 20 from the door 21 or other support surface.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. A support for dispensing packages and the like comprising a panel body adapted for attachment to the interior of a cabinet door or the like, said panel body having at least one elongated adjustment slot formed therethrough across the panel body, and at least a pair of adjustable dispensing package holder units on one side of the panel body adjacent said slot, each holding unit adapted to engage one end portion of the dispensing package and each holding unit comprising first and second bracket parts, fastener means connecting each first bracket part adjustably with the panel body through said slot, slotted fastener means adjustably connecting said first and second bracket parts of each holder unit adjustably along an axis perpendicular to the panel body, each first bracket part having a lower flange adapted to engage beneath opposite end portions of a dispensing package to support the package, and each second bracket part having a flange perpendicular to the last-named flange adapted to overlap a side wall of a dispensing package spaced forwardly of the panel body and in a plane parallel thereto.

2. A support for dispensing packages and the like as defined in claim 1, and a plurality of said elongated adjustment slots in the panel body in parallel spaced relation, and plural pairs of said adjustable holder units, each holder unit being adjustably connected with the panel body through one slot of the panel body, whereby each pair of holder units is independently adjustable on the panel body and the panel body is able to support plural differently sized dispensing packages in spaced parallel relationship.

3. A support for dispensing packages and the like as defined in claim 1, and said first bracket part of each holding unit having first and second right angular webs to engage beneath a dispensing package and to lie in opposing relationship to one end of a package respectively, and a third web formed at right angles to said second web and lying adjacent to one face of the panel body and connected therewith adjustably through said slot of the panel body.

4. A support for dispensing packages and the like as defined in claim 3, and said second bracket part of each holding unit having a pair of right angular webs and one such web of the second bracket part lying on said second web of the first bracket part and slotted adjustable fastener means interconnecting the last-named webs of the first and second bracket parts.

5. A support for dispensing packages and the like as defined in claim 4, and one web of said second bracket part extending parallel to said third web of the first bracket part and extending oppositely to the third web in relation to said second web of the first bracket part.

6. A support for dispensing packages and the like as defined in claim 1, and a pair of L-shaped retainer brackets attachable adjustably to said package holder units and enabling said panel body and holder units to be mounted in a horizontal position of use, said L-shaped retainer brackets then preventing displacement of a dispensing package horizontally in the plane of the panel body.

7. A support for dispensing packages and the like as defined in claim 6, and one leg of each L-shaped retainer bracket being slotted for adjustable engagement with the slotted fastener means which adjustably connects the first and second bracket parts of each holder unit.

8. A support for dispensing packages and the like as defined in claim 1, and said panel body being substantially vertically disposed in use, and said pair of package holder units being open and unobstructed at their tops so that a dispensing package may engage downwardly into and between said holder units and be supported at its bottom, opposite ends and opposite sides by said holder units and said panel body.

9. A support for dispensing packages and the like as defined in claim 1, and a pair of opposite side rearwardly extending flanges on the panel body projecting away from the package holder units on the other side of the panel body, and a ledge member adjustably interconnected with said flanges adjacent the rear side of the panel body.

10. A support for dispensing packages and the like as defined in claim 9, and said ledge member lying perpendicular to said side flanges and panel body, and slotted fastener means connecting opposite ends of the ledge member with said side flanges, whereby the ledge member can be adjusted longitudinally of the side flanges and locked, the ledge member and side flanges forming with said panel body and the opposing surface on which the support is mounted an end opening compartment for loose bags and the like at the side of the panel body away from dispensing packages being supported.

11. A support for dispensing packages and the like as defined in claim 1, and said slot having one end terminal thereof enlarged to allow ready separation from the panel body of said fastener means connecting each first bracket part adjustably with the panel body through said slot.

* * * * *